US006145328A

United States Patent [19]

Choi

[11] Patent Number: 6,145,328

[45] Date of Patent: Nov. 14, 2000

[54] AIR CONDITIONER HAVING POWER COST CALCULATING FUNCTION

[75] Inventor: Kwang-soo Choi, Kyungki-do, Rep. of Korea

[73] Assignee: Samsung Electronics Co., Ltd., Suwon, Rep. of Korea

[21] Appl. No.: 09/238,496

[22] Filed: Jan. 27, 1999

[30] Foreign Application Priority Data

Feb. 19, 1998 [KR] Rep. of Korea ..... 98-5162

[51] Int. Cl.[7] ..... G05D 23/00; F25B 49/00

[52] U.S. Cl. ..... 62/127; 62/230; 236/94

[58] Field of Search ..... 165/11.1; 62/230, 62/127, 129; 236/94; 324/113; 219/506

[56] References Cited

U.S. PATENT DOCUMENTS 4,716,957 1/1988 Thompson et al. ..... 236/94 X
4,971,136 11/1990 Mathur et al. ..... 236/94 X

*Primary Examiner*—William Wayner
*Attorney, Agent, or Firm*—Burns, Doane, Swecker & Mathis, L.L.P.

[57] ABSTRACT

An air conditioner enables a user to input a desired monthly power cost for all electrical appliances, including the air conditioner. A microcomputer is able to calculate the accumulated power cost of operating the air conditioner for the month, as well as an expected power cost for operating all of the appliances. If the desired power cost for the month is below the expected power cost, the air conditioner is automatically operated in a power saving mode.

10 Claims, 4 Drawing Sheets

AIR CONDITIONER HAVING POWER COST CALCULATING FUNCTION

BACKGROUND OF THE INVENTION

1. Field of the Invention

The present invention relates to an air conditioner, and to a way of economically utilizing an air conditioner.

2. Description of the Prior Art

FIG. 1 is an exploded perspective view showing a conventional air conditioner. Referring to FIG. 1, the air conditioner has a base 1, a compressor 2 and a motor 3. The compressor 2 compresses the refrigerant into a high temperature and high pressure, and the motor 3 generates a rotary power for the compressor. The compressor 2 and the motor 3 are installed on the base 1. A partition 1*a* divides the air conditioner into an indoor section and an outdoor section.

A blower 4 is installed at a front side of the motor 3, i.e., in the indoor section, while a cooling fan 5 is installed at a rear side of the motor 3, i.e., in the outdoor section. An indoor heat-exchanger 6 is installed at the front side of the blower 4. An outdoor heat-exchanger 7 is installed at the rear side of the cooling fan 5 so as to condense the high temperature and high pressure refrigerant introduced from the compressor 2 into a liquefied low temperature and low pressure refrigerant. Additionally, a capillary tube 6*a* is connected to the indoor heat-exchanger 6. The refrigerant introduced from the outdoor heat-exchanger 7 is decompressed as it passes through the capillary tube 6*a* so as to be a low temperature and low pressure refrigerant and flows into the indoor heat-exchanger 6.

The base 1, and the above-mentioned elements installed on the base 1 are encased by a body 8. Also, a front panel 9 is fixed at the front portion of the indoor heat-exchanger 6. The front panel 9 has indoor suction ports 9*a* through which the indoor air is sucked, and indoor discharge ports 9*b* through which the indoor air is discharged. Outdoor suction ports 8*a* through which an outdoor air is sucked and outdoor discharge ports (not shown) through which the outdoor air is discharged are respectively formed in the body 8.

FIG. 2 is a block diagram showing a conventional air conditioner. Referring to FIG. 2, operation commands are inputted through an input section 20. A temperature detecting section 60 detects an indoor temperature. A microcomputer 30 receives the commands from the input section 20, and the indoor temperature from the temperature detecting section 60 so as to accordingly control a load driving section 40 which will be described later.

The load driving section 40 drives the compressor 2 and motor 3 (both shown in FIG. 1) so as to carry out the cooling operation. Also, the microcomputer 30 displays the operational status through a display section 50. The microcomputer 30 operates under power supplied from a power supply 10.

The operation of the conventional air conditioner constructed as above will be described in greater detail hereinbelow.

First, as the power is applied to the air conditioner, the user inputs the operation commands through the input section 20. The microcomputer 30 receives the commands from the input section 20 and the indoor temperature from the temperature detecting section 60 so as to accordingly control the load driving section 40.

Accordingly, as the compressor 2 is operated by the motor 3, the refrigerant circulates through the refrigerant cycle. The refrigerant is heat-exchanged by the outdoor heat-exchanger 7 and the indoor heat-exchanger 6. The cooling fan 5 and the blowing fan 4 respectively circulate air through the outdoor heat-exchanger 7 and the indoor heat-exchanger 6.

In the outdoor section, the outdoor air sucked through the outdoor suction ports 8*a* by the cooling fan 5 is heat-exchanged with the high temperature refrigerant therein while the air blows through the outdoor heat-exchanger 7. Thus, the high temperature refrigerant in the outdoor heat-exchanger 6 becomes a low temperature refrigerant, and heated air is discharged.

In the indoor section, the indoor air sucked through the indoor suction ports 9*a* by the blowing fan 4 is cooled by being heat-exchanged with the low temperature refrigerant therein. Then, as the cooled air is discharged to the room through the indoor discharge ports 9*b*, the cooling operation is carried out.

A problem arises in that such an air conditioner consumes much more power than other home appliances. It is a well-known fact that an air conditioner consumes as much power as thirty electric fans.

Furthermore, the conventional air conditioner has no function of displaying the power consumption data. Thus, the consumers are not aware how much power the air conditioner has consumed, or how much the power rates therefor would be. Accordingly, the consumer operates the air conditioner not according to economic considerations, but only according to physical convenience so that there will occur an excessive power consumption in load peak periods such as during summer.

Also, the over use of power in certain periods can cause a power shortage.

SUMMARY OF THE INVENTION

The present invention has been made to overcome above described problems, and accordingly it is an object of the present invention to provide an air conditioner having functions for calculating and displaying accumulated power cost and expected power cost, and for conserving electricity.

Another object of the present invention is to provide a method for controlling an air conditioner to operate on a power saving mode in accordance with a previously-inputted desired power cost.

The above-described objects are accomplished by an air conditioner according to the present invention comprising an input section through which the user inputs the operation commands; a temperature detecting section for detecting an indoor temperature; a load driving section for driving a compressor and a motor in accordance with signals from the input section and the temperature detecting section so as to carry out the cooling/heating operation; a power detecting section for measuring the power consumed during the cooling/heating operation; a microcomputer for controlling the load driving section in accordance with the commands from the input section and the temperature from the temperature detecting section, and for calculating the power cost for the power consumption of the air conditioner and the expected power cost for the power consumption of all home appliances; and a display section, controlled by the microcomputer, for selectively displaying the power cost of air conditioner and a current month's expected power cost of all the electrical home appliances.

In addition, the method for controlling an air conditioner according to the present invention comprises the steps of: (1) driving the load driving section in accordance with inputted commands so as to carry out heating/cooling operation; (2) storing and displaying a power cost for an accumulated power consumption of the air conditioner by obtaining a current power consumption data through a power detecting section during the heating or cooling operation; and (3) calculating and displaying the expected power cost of all the electrical home appliances including the air conditioner for a current month after calculating the expected power cost as a function of the power consumption accumulated for a predetermined period of time.

According to the present invention, since the power cost for the accumulated power consumption of the air conditioner and the expected monthly power cost of all of home electrical appliances are displayed for the user, the user is able to operate the air conditioner as he planned. Also, since the air conditioner can automatically and selectively operate in a power saving mode upon receiving the desired power cost, electricity is conserved, and excessive power consumption and subsequent power shortages may be prevented.

BRIEF DESCRIPTION OF THE DRAWINGS

The above objects and advantages will be more apparent from the detailed description of a preferred embodiment of the present invention with reference to the reference drawing accompanied, in which.

DETAILED DESCRIPTION OF THE PREFERRED EMBODIMENT

Figure 3:
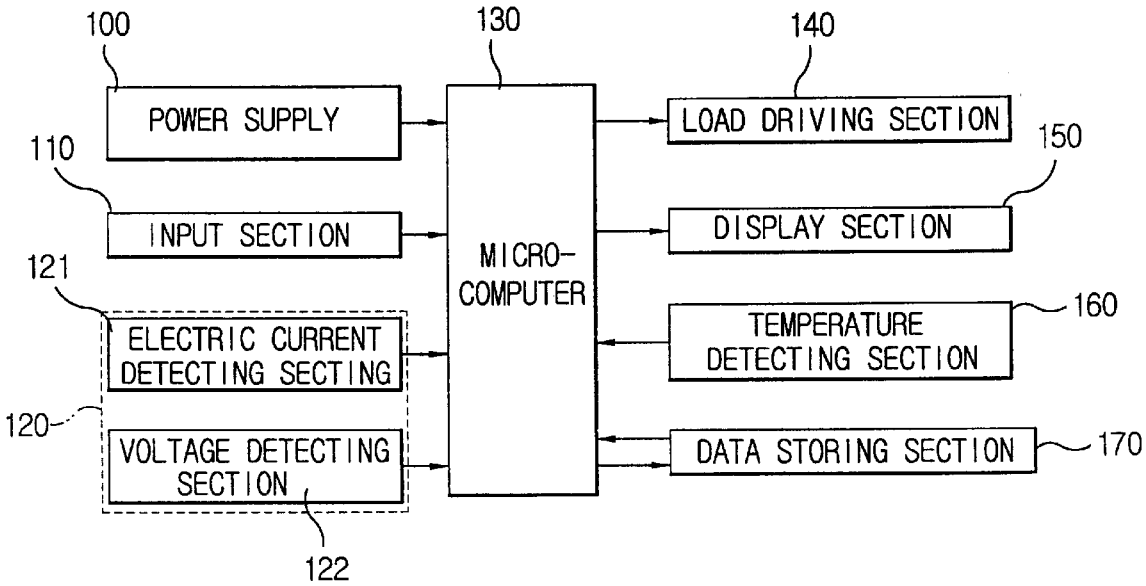
FIG. 3 is a block diagram showing an air conditioner having a power cost calculating function according to the preferred embodiment of the present invention.
Figure 4:
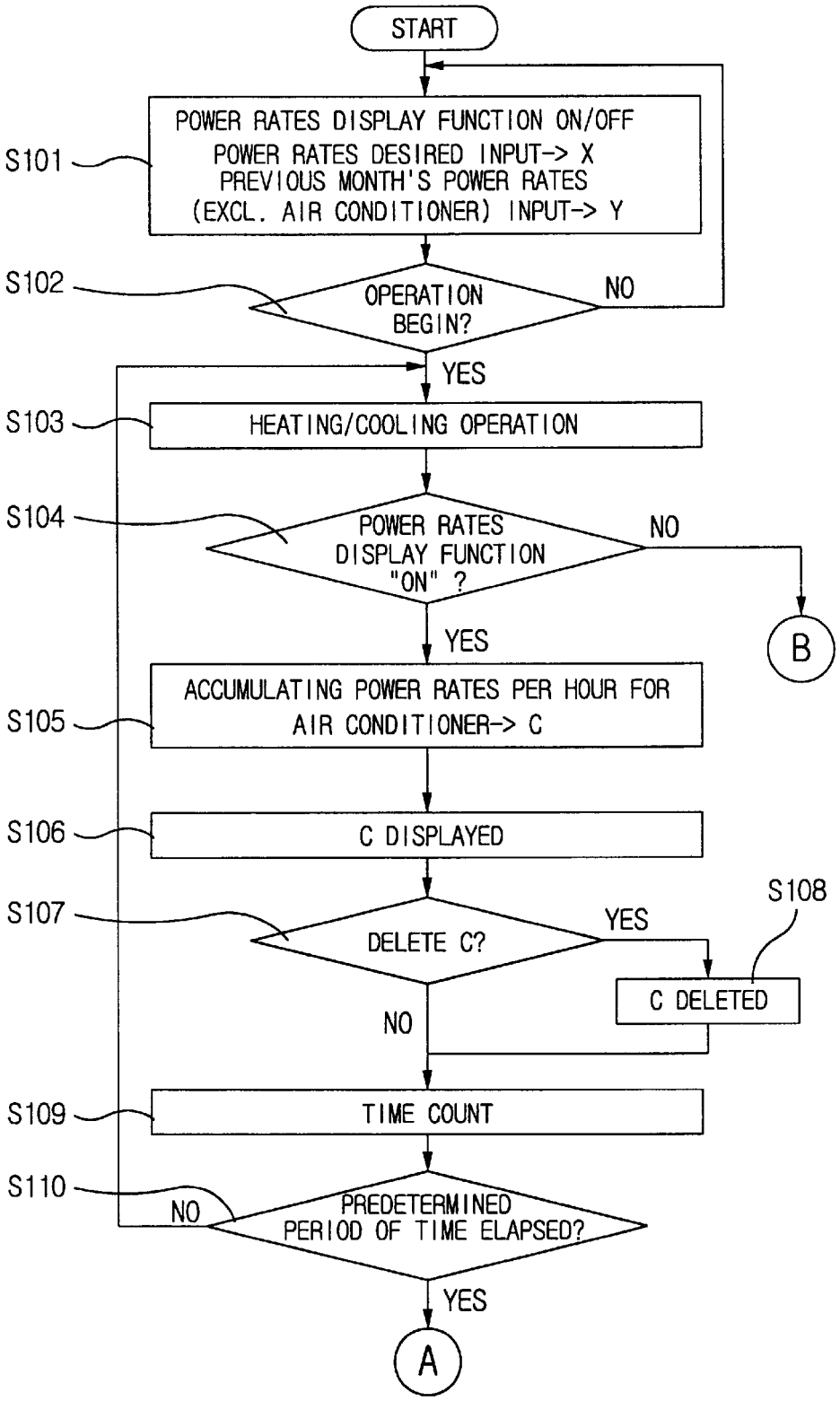
FIGS. 4 and 5 are flow charts illustrating a method for controlling an air conditioner having a power cost calculating function according to the present invention.
Figure 5:
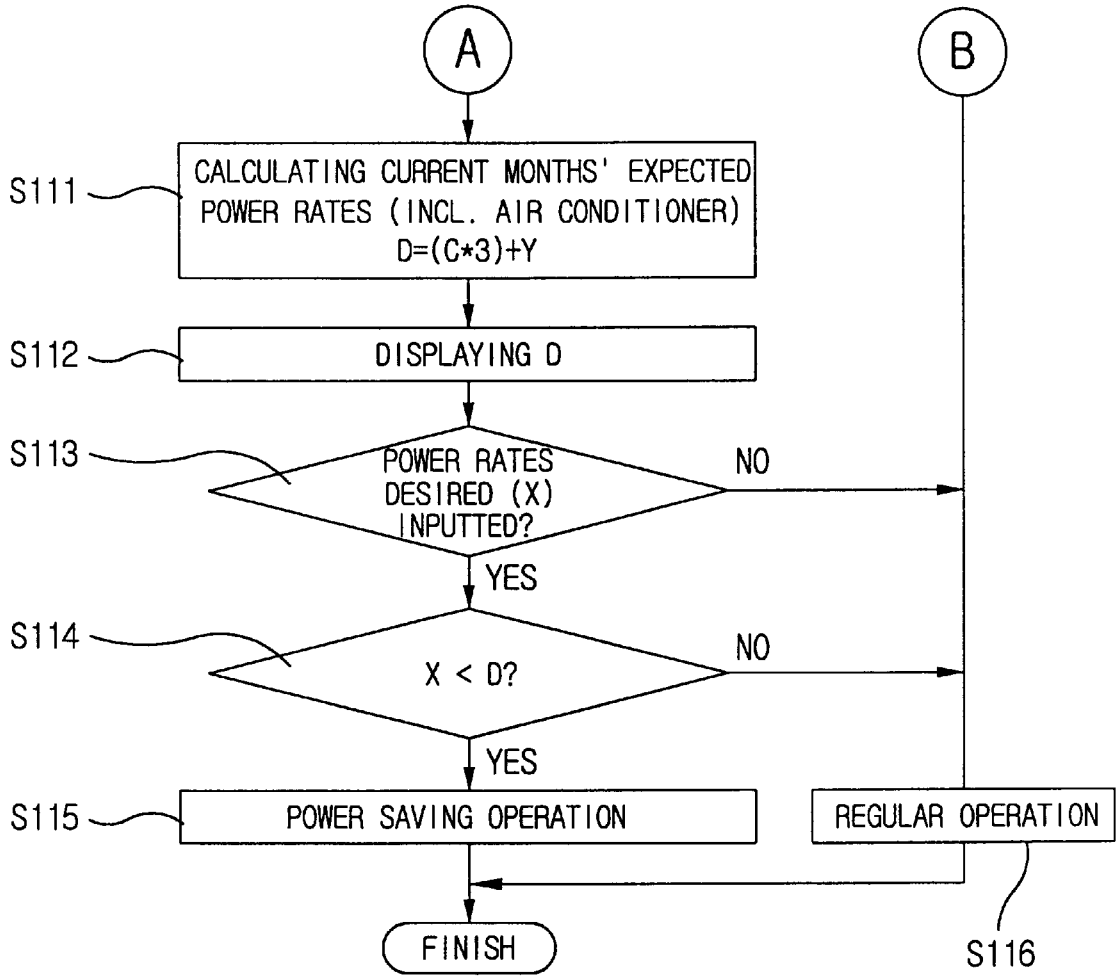

FIG. 3 is a block diagram showing an air conditioner according to the preferred embodiment of the present invention. FIGS. 4 and 5 are flow charts illustrating a method for controlling an air conditioner of the present invention.

Referring to FIG. 3, the air conditioner according to the preferred embodiment of the present invention has a power supply 100, an input section 110, a power detecting section 120, a microcomputer 130, a load driving section 140, a display section 150, a temperature detecting section 160, and a data storing section 170.

Figure 1:
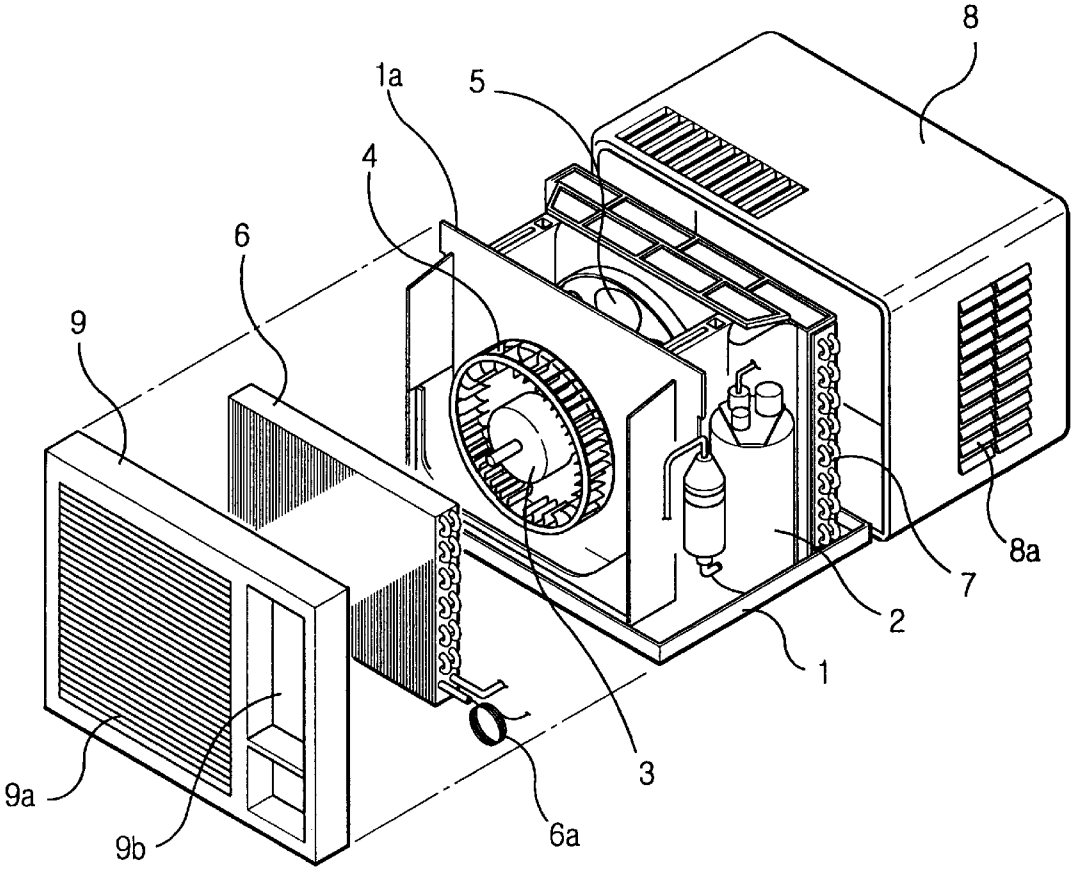
FIG. 1 (PRIOR ART)
FIG. 1 is an exploded perspective view showing a conventional air conditioner.
Figure 2:
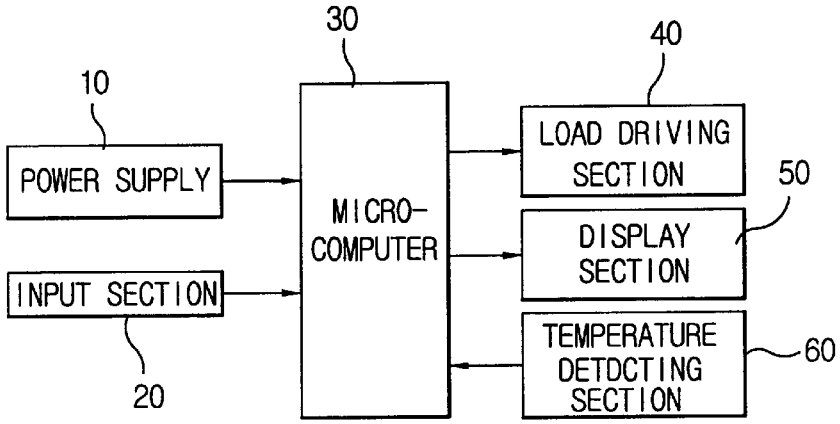
FIG. 2 (PRIOR ART)
FIG. 2 is a block diagram showing the conventional air conditioner.

The operation commands, and a desired power cost for all electrical appliances, including the air conditioner (hereinafter referred to as X) are inputted through the input section 110 by the user. The temperature detecting section 160 detects an indoor temperature. The load driving section 140 drives a compressor 2 and a fan motor 3 (both shown in FIG. 1) so as to carry out heating/cooling operation.

The power detecting section 120 provides power consumption data. The power detecting section 120 includes an electric current detecting subsection 121 for providing electric current consumption data and a voltage detecting subsection 122 for providing voltage consumption data.

The microcomputer 130 controls the load driving section 140 in accordance with the commands inputted through the input section 110 and the temperature data obtained by the temperature detecting section 160. Also, the microcomputer 130 calculates: (i) the power cost for the accumulated power consumption of the air conditioner alone (hereinafter referred to as C) using the air conditioner's power consumption provided by the power detecting section 120, and (ii) the expected power cost for power consumption of all of home appliances including the air conditioner, for the current month, (hereinafter referred to as D).

Once X is inputted through the input section 110, then the microcomputer 130 again controls the load driving section 140 by comparing the X with D. If X becomes less than D, then the load driving section 140 operates in a power saving mode. If X equals D, or is greater than D, then the load driving section 140 operates in a regular mode.

Controlled by the microcomputer 140, the display section 150 displays the operational status, the accumulated power cost C, and the expected cost D. Also controlled by the microcomputer 130, the data storing section 170 stores/reads the data such as the desired power cost X, the accumulated power cost C, and the current month's expected power cost D, or the like.

The operation of the present invention constructed as described above will be described in greater detail with respect to FIGS. 4 and 5 utilizing the following data (wherein "A/C" means air conditioner):

X=desired power cost for all electrical appliances, including A/C

C=accumulated cost for A/C alone

D=expected power cost for all electrical appliances, including A/C, for the current month Y=previous month's average power cost for all electrical appliances excluding A/C First, the user manipulates the keys (on/off) of the input section 110 for a power cost displaying function. Then, the user inputs the desired power cost as well as a previous month's average power cost of home appliances excluding the air conditioner (hereinafter referred to as Y). Upon receiving the X and Y values, the microcomputer 130 stores the same into the data storing section 170 (S101).

Then, as the user inputs a heating or cooling command, the air conditioner operates and drives the load driving section 140 so as to carry out the heating or cooling operation (S102~S103).

While the air conditioner operates in the heating or cooling mode, the microcomputer 130 determines whether or not the power cost displaying function has been selected (S104). If the power cost displaying function has not been selected, the air conditioner operates in the regular mode (S116). If the power cost displaying function has been selected, the microcomputer 130 detects the present power consumption of the air conditioner through the power detecting section 120 and accumulates and displays the accumulated power cost according to the present power consumption (S105~S106).

The microcomputer 130 reads Y which was previously inputted to the data storing section 170, and thereby calculates D. The progressive rates provided in the following Table 1 are applied, as an example, for calculating D.

TABLE 1

| Power consumption | within 10kW | within 50kW | within 100kW | within 150kW |
|---|---|---|---|---|
| hourly rates | ₩100 | ₩120 | ₩140 | ₩160 |

Based on the progressive rates as above, let us suppose that Y is ₩1000, where ₩ is a monetary value. Then the microcomputer 130 calculates C (the current accumulated amount of power consumption of the air conditioner times ₩120) and accumulates C into the data storing section 170, and displays C at the display section 150.

While displaying C, if a "CLEAR" command is inputted, then the microcomputer 130 deletes accumulated C and prepares to store another data (S107~S108).

After that, the microcomputer 130 carries out a step of calculating and displaying D (S109~S112). More specifically, if a predetermined period of time (e.g. ten days) has elapsed, D is calculated using C and Y.

The microcomputer 130 calculates the expected power cost for the current month's power consumption of the air conditioner (C×3; supposing a month has thirty days and ten days have elapsed). Subsequently, the microcomputer 130 calculates D, wherein D=(C×3)+Y.

Again, assuming that the previous month's average power cost is ₩1,000 and the air conditioner has operated for ten days consuming 2 kW of power per day. Then, D therefor is calculated as follows:

$$D=[(10\times2\times120\times3)+1000]=7200+1000=₩8,200$$

The microcomputer 130 then displays D at the display section 150. Thus, the user is able to operate the air conditioner as planned so that he/she may prevent excessive use of power.

The microcomputer 130 then controls the operational status of the load driving section 140 by determining whether or not X has been inputted. When X has not been inputted, the microcomputer 130 carries out the regular operation (S116). When X has been inputted, the microcomputer 130 compares X with D and determines if X is below D (S114).

If X is below D, the microcomputer 130 operates the load driving section 140 in a power saving mode (S115). If X is equal to D, or is above D, then the microcomputer 130 operates the load driving section 140 in a regular mode (S116).

Assuming that X is inputted as ₩4,600, then the microcomputer 130 determines that X (i.e., ₩4,600) is below D (i.e., ₩8,200) so that the microcomputer 130 carries out the power saving operation. More specifically, the microcomputer 130 subtracts Y from X (i.e., ₩4,600−₩1,000=₩3,600). Thus, the desired power cost for the current month for A/C alone is ₩3,600. Then the microcomputer 130 divides ₩3,600 by thirty days (₩3,600÷30=₩120) so as to calculate the desired daily power cost for the air conditioner. In accordance with X, the microcomputer 130 controls the air conditioner not to consume more power than 1 kW (₩120). For example, if the microcomputer determines that it can only operate for two hours per day to avoid exceeding the daily power cost, then it could repeatedly shut down for short time periods to perform the two hours of operation over a long time span.

As described, according to the present invention, since the power cost of the air conditioner and the current month's expected power cost for all of the home appliances including the air conditioner are displayed, the consumer is able to operate the air conditioner as planned so that he/she may conserve electricity.

Further, since the air conditioner is controlled in accordance with the desired power cost, electricity can be conserved.

Yet another advantage of the present invention is that the consumers can conserve electricity so that a power shortage during a load peak period is prevented.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A method of controlling an air conditioner comprising the steps of:

A. driving an air conditioner in accordance with operation commands manually inputted;

B. detecting a power consumption of the air conditioner and displaying an estimated and accumulated power cost thereof; and C. calculating an expected power cost of all electrical appliances for the current month and displaying the same.

2. The method according to claim 1 further including the step of inputting to the controller a previous month's average power cost for power consumption of all electrical appliances excluding the air conditioner, wherein the step C comprises the steps of calculating an expected power cost for the air conditioner based upon the accumulated power cost for the air conditioner estimated in step B, and calculating the current month's expected power cost by adding the expected power cost for the air conditioner to the previous month's average power cost for power consumption of all appliances excluding the air conditioner.

3. The method according to claim 1 further including the step of displaying the accumulate power cost for the air conditioner and the current month's expected power cost for all electrical appliances after applying a current hourly power cost rate.

4. The method according to claim 1 further comprising the steps of manually inputting a desired power cost for all electrical appliances, comparing the desired power cost with the expected power cost from step C, and operating the air conditioner in a power-saving mode when the desired power cost is less than the current month's expected power cost.

5. An air conditioner comprising:

an input section enabling a user to manually input commands;

a temperature detector for detecting a room temperature;

a load driving section for carrying out cooling/heating operation in accordance with the commands;

a power detector for detecting a consumption of power consumed by the load driving section;

a microcomputer for operating the load driving section in accordance with the commands, the microcomputer being operable to calculate an accumulated power cost from the power consumption detected by the power detector and an expected power cost for operating all electrical appliances for the current month; and a display for displaying the accumulated power cost for the air conditioner and the current month's expected power cost for all electrical appliances.

6. The air conditioner according to claim 5 further comprising a storage section for storing the accumulated power cost for the air conditioner and the current month's expected power cost for all electrical appliances.

7. The air conditioner according to claim 5 wherein the input section enables a desired power cost for all electrical appliances to be manually input, the microcomputer being operable to compare the desired power cost with the estimated power cost for all electrical appliances.

8. The air conditioner according to claim 7 wherein the microcomputer is operable to drive the load driving section in a power saving mode when the desired power cost is less than the expected power cost.

9. The air conditioner according to claim 5 wherein the power detector further includes a voltage detecting section to detect a voltage consumed during operation of the air conditioner.

10. The air conditioner according to claim 5 wherein the power detector further includes an electric current detecting section to detect current consumed during operation of the air conditioner.

* * * * *